US012758023B2

(12) United States Patent
Leng

(10) Patent No.: US 12,758,023 B2
(45) Date of Patent: Oct. 13, 2026

(54) FOLDABLE BED FRAME

(71) Applicant: NEW-TEC INTEGRATION (XIAMEN) CO., LTD., Fujian (CN)

(72) Inventor: Luhao Leng, Xiamen (CN)

( * ) Notice: Subject to any disclaimer, the term of this patent is extended or adjusted under 35 U.S.C. 154(b) by 129 days.

(21) Appl. No.: 18/704,847

(22) PCT Filed: Oct. 27, 2022

(86) PCT No.: PCT/CN2022/128018

§ 371 (c)(1),
(2) Date: Apr. 25, 2024

(87) PCT Pub. No.: WO2023/072211

PCT Pub. Date: May 4, 2023

(65) Prior Publication Data

US 2025/0255416 A1 Aug. 14, 2025

(30) Foreign Application Priority Data

Oct. 29, 2021 (CN) ..... 202111271464.2

(51) Int. Cl.
*A47C 19/12* (2006.01)
*A47C 19/02* (2006.01)
*A47C 19/04* (2006.01)

(52) U.S. Cl.
CPC ..... *A47C 19/122* (2013.01); *A47C 19/024* (2013.01); *A47C 19/028* (2013.01); *A47C 19/04* (2013.01)

(58) Field of Classification Search
CPC ..... A47C 19/122; A47C 17/50; A47C 17/70; A47C 17/80; A47C 19/02; A47C 19/025; A47C 19/20; A47C 19/005; A47C 19/024; A47C 19/028; A47C 19/04; A47C 19/22; A47D 9/005; A47D 7/002; A47D 13/061; A47D 13/063; A47D 7/01; A47D 9/008; A47D 9/012; A47D 9/016; A61H 2003/002; A61H 2003/003; A61H 2201/0161; A61H 2201/1633; A61H 3/04
See application file for complete search history.

(56) References Cited

U.S. PATENT DOCUMENTS

2009/0106896 A1* 4/2009 Olah ..... A47C 17/50 5/118

FOREIGN PATENT DOCUMENTS

CN 203693019 U * 7/2014
CN 203987064 U * 12/2014
(Continued)

OTHER PUBLICATIONS

"On." Merriam-Webster, Merriam-Webster, Sep. 3, 2018, www.merriam-webster.com/dictionary/on (Year: 2018).*
(Continued)

*Primary Examiner* — Madison Matthews
(74) *Attorney, Agent, or Firm* — Ashurst Perkins Coie US LLP

(57) ABSTRACT

A supporting device for a foldable bed frame includes a hinge at an upper end of an upper support member, a movable support member vertically movable on the upper support member, a bracket on the movable support member, and first and second diagonal pull rods, a first end of each pull rod pivotally attached to the bracket, and a second end of each pull rod pivotally attached to the first upper bed frame and to the second bed frame, respectively.

15 Claims, 13 Drawing Sheets

(56) References Cited

FOREIGN PATENT DOCUMENTS

| | | | | | |
|---|---|---|---|---|---|
| CN | 205018659 | U | | 2/2016 | |
| CN | 106037347 | A | * | 10/2016 | ..... A47D 9/005 |
| CN | 206534385 | U | * | 10/2017 | |
| CN | 111887663 | A | | 11/2020 | |
| CN | 113892780 | A | | 1/2022 | |
| CN | 217524418 | U | | 10/2022 | |

OTHER PUBLICATIONS

English translation of International Search Report for International Application No. PCT/CN2022/128018; Date of Mailing: Jan. 18, 2023; 3 pages.

* cited by examiner

FOLDABLE BED FRAME

TECHNICAL FIELD

The present disclosure relates to the field of beds, and particularly to a supporting device for a foldable bed frame, as well as a bed frame and a bed comprising the same.

BACKGROUND

Most conventional large-sized furniture is not easily disassembled or reassembled, although this is frequently needed. Disassembly of a beds can be difficult. As a result, still usable beds are sometimes discarded instead of moving them.

Foldable bed frames can be folded and unfolded to facilitate transport and storage.

However, existing foldable bed frames have complicated structures and need a lot of folding steps which affect the bed enclosure and appearance.

SUMMARY

To address at least some of the problems existing in the prior art products, one of the objectives of the present disclosure is to provide a supporting device adapted for a foldable bed frame. The foldable bed frame assembled with the supporting device is simple in structure, can be folded or unfolded through one action, thereby reducing the folding steps and improving the convenience in use, and meanwhile can enhance stability of the unfolded bed frame.

In order to achieve the above objective, in one aspect, the present disclosure provides a supporting device adapted for a foldable bed frame, comprising: an upper support member provided at an upper end thereof with a hinge structure configured to be mounted at an upper folding part of the bed frame; a movable support member configured to be movably disposed on the upper support member in a height direction of the bed frame and configured to contact the ground when in an extended position as so to cooperate with a ground support brace of the bed frame and support the bed frame, wherein the movable support member is hinged thereon with a bracket that can be moved with the movable support member, and the bracket has a first diagonal pull rod configured to hinge to a first side upper bed frame of an upper bed frame, and a second diagonal pull rod configured to hinge to a second side upper bed frame of the upper bed frame.

In the above technical solution, the supporting device for the foldable bed frame includes the upper support member and the movable support member, the upper support member being provided with a hinge structure including, for example, the first hinge portion and the second hinge portion, and the movable support member being movably disposed on the upper support member in the height direction of the bed frame and being hinged thereon with the first diagonal pull rod and the second diagonal pull rod. When the supporting device is assembled with the first side upper bed frame and the second side upper bed frame to form a bed frame, the first side upper bed frame and the second side upper bed frame are connected with the hinge structure. For example, the first upper bed frame is connected with the first hinge portion, and the second side upper bed frame is connected with the second hinge portion; and at the same time, the first diagonal pull rod is hinged with the first upper bed frame, and the second diagonal pull rod is hinged with the second side upper bed frame. As such, when the unfolded bed frame is to be folded up, it is only required to lift up the middle portion of the bed frame, and then the first side upper bed frame and the second side upper bed frame can be rotated to be close to each other for folding. Meanwhile, the first diagonal pull rod and the second diagonal pull rod drive the movable support member to move downwards, which in turn forces the first side upper bed frame and the second side upper bed frame to be further close to each other until the folding is completed. When the folded bed frame is to be unfolded, an one-action unfolding of the bed frame can be achieve only by respectively pull the first side upper bed frame and the second side upper bed frame in two opposite directions. After the bed frame is unfolded, since the first diagonal pull rod is obliquely connected between the first side upper bed frame and the movable support member while the second diagonal pull rod is obliquely connected between the second side upper bed frame and the movable support member, the first diagonal pull rod and the second diagonal pull rod can respectively form a triangular support structure at two sides of the movable support member. This can further improve the stability of the unfolded bed frame. Therefore, the bed frame assembled with the supporting device is simple in structure, the bed frame can be folded or unfolded through one action, thereby reducing the folding steps and improving the convenience in use, and can enhance stability of the unfolded bed frame.

According to an embodiment of the present disclosure, the upper support member comprises a side enclosure rod hinge portion configured to respectively hinge to a first lower side enclosure rod and a second lower side enclosure rod of the bed frame, wherein the first lower side enclosure rod is configured to hinge to a first ground support brace hinged onto the first side upper bed frame, and the second lower side enclosure rod is configured to hinge to a second ground support brace hinged onto the second side of upper bed frame.

According to an embodiment of the present disclosure, the hinge structure comprises a first hinge portion for mounting the first side upper bed frame, and a second hinge portion for mounting the second side upper bed frame.

According to an embodiment of the present disclosure, the first hinge portion and the second hinge portion are hinged to an upper end of the upper support member at a same hinge point, wherein the first hinge portion comprises a first engagement post or first engagement slot for fitting with a first edge side rod of the first side upper bed frame, and the second hinge portion comprises a second engagement post or second engagement slot for fitting with a second edge side rod of the second side upper bed frame.

According to an embodiment of the present disclosure, each of the first hinge portion and the second hinge portion is shaped by bending a same plate sheet to form a hinge plate portion, an engagement plate post or an engagement plate slot.

According to an embodiment of the present disclosure, the upper support member is fixedly provided at its upper end with a mounting plate, and two opposite ends of the mounting plate are respectively served as the first hinge portion and the second hinge portion.

According to an embodiment of the present disclosure, the upper support member is formed with an axial channel therein, and the movable support member can be telescopically disposed within the axial channel.

According to an embodiment of the present disclosure, the length of the first diagonal pull rod and the second diagonal pull rod can be adjusted respectively.

In the another aspect, the present disclosure provides a bed frame comprising an upper bed frame having a first side upper bed frame and a second side upper bed frame, and two separated supporting devices according to any one of the embodiments as described above, wherein an end of the first side upper bed frame and an end of the second side upper bed frame are mounted to the hinge structures of the two of the supporting devices for the foldable bed frame, the first diagonal pull rod is hinged to the first side upper bed frame, and the second diagonal pull rod is hinged to the second side upper bed frame, and wherein the first side upper bed frame and the second side upper bed frame can be folded and unfolded.

In the technical solution, as described above, with the supporting device according to the above disclosure, the bed frame has a simple structure, can be folded and unfolded through one action, thereby reducing the folding steps and improving the convenience in use, and can enhance the stability when unfolded.

According to an embodiment of the present disclosure, the bed frame comprises a first lower side enclosure rod and a second lower side enclosure rod, wherein two ends of the first lower side enclosure rod are respectively hinged to the upper support members, and a rod section between the two ends of the first lower side enclosure rod is hinged to a first ground support brace hinged onto the first side upper bed frame, such that the first side upper bed frame, the first ground support brace, the first lower side enclosure rod and the upper support member can form a four-rod linkage; and wherein two ends of the second lower enclosure rod are respectively hinged to the upper support members, and a rod section between the two ends of the second lower enclosure rod is hinged to a second ground support brace hinged onto the second side upper bed frame, such that the second side upper bed frame, the second ground support brace, the second lower side enclosure rod and the upper support member can form a four-rod linkage. When the first side upper bed frame and the second side upper bed frame are folded up, the first lower side enclosure rod can drive the first ground support brace to invert over and fold towards an end of the bed frame, and the second lower side enclosure rod can drive the second ground support brace to invert over and fold towards an opposite end of the bed frame.

According to an embodiment of the present disclosure, the first side upper bed frame and the second side upper bed frame are provided at side edges thereof with connection structures for allowing a plurality of bed frames to be spliced and connected in sequence.

According to an embodiment of the present disclosure, the connection structure has an extended position where the connection structure protrudes from the side edge, and a retracted position where the connection structure is positioned lower than the side edge.

According to an embodiment of the present disclosure, the connection structure comprises a first structure and a second structure that are different and can cooperate with each other, wherein the first structure and the second structure are respectively located on side edges of two opposite sides of the first side upper bed frame and the second side upper bed frame, and wherein the first structure on one side of the first side upper bed frame and the second structure on one side of the second side upper bed frame are located on a same side surface, and the second structure on the other side of the first side upper bed frame and the first structure on the other side of the second side upper bed frame are located on a same side surface.

According to an embodiment of the present disclosure, the first structure comprises a hitching post having a stop head, and the second structure comprises a hitching sheet that comprises a raised sheet portion forming a receiving space and having an entrance port, wherein the hitching post can enter the entrance port such that the stop head is located in the receiving space and stopped on an inner surface of the raised sheet portion.

In a further aspect, the present disclosure also provides a bed comprising the bed frame according to any one of the above-described disclosure and embodiments.

Obviously, elements or features as described in a single one embodiment can be used, alone or in combination, in other embodiment(s).

BRIEF DESCRIPTION OF THE DRAWINGS

Dimensions and proportions in the drawings do not represent the dimensions and proportions of actual products. The drawings are only provided illustratively, and some unnecessary elements or features are omitted therefrom for clarity.

REFERENCE SIGNS

1—upper support member, 2—movable support member, 3—first side upper bed frame, 4—first hinge portion, 5—second side upper bed frame, 6—second hinge portion, 7—first diagonal pull rod, 8—second diagonal pull rod, 9—first lower side enclosure rod, 10—second lower side enclosure rod, 11—side enclosure rod hinge portion, 12—first ground support brace, 13—second ground support brace, 14—first edge side rod, 15—second edge side rod,

16—hinge plate portion, 17—engagement plate post, 18—mounting plate, 19—supporting device, 20—first structure, 21—second structure, 23—hitching post, 24—hitching sheet, 25—receiving space, 26—raised sheet portion, 27—entrance port, 28—bed frame.

DETAILED DESCRIPTION OF EMBODIMENTS

Reference now will be made to the drawings to describe in detail the present disclosure. What will be described herein will only cover preferred embodiments of the present disclosure, and those skilled in the art would envision, on the basis of the preferred embodiments, other possible manners which also fall into the scope described herein.

Figure 1:
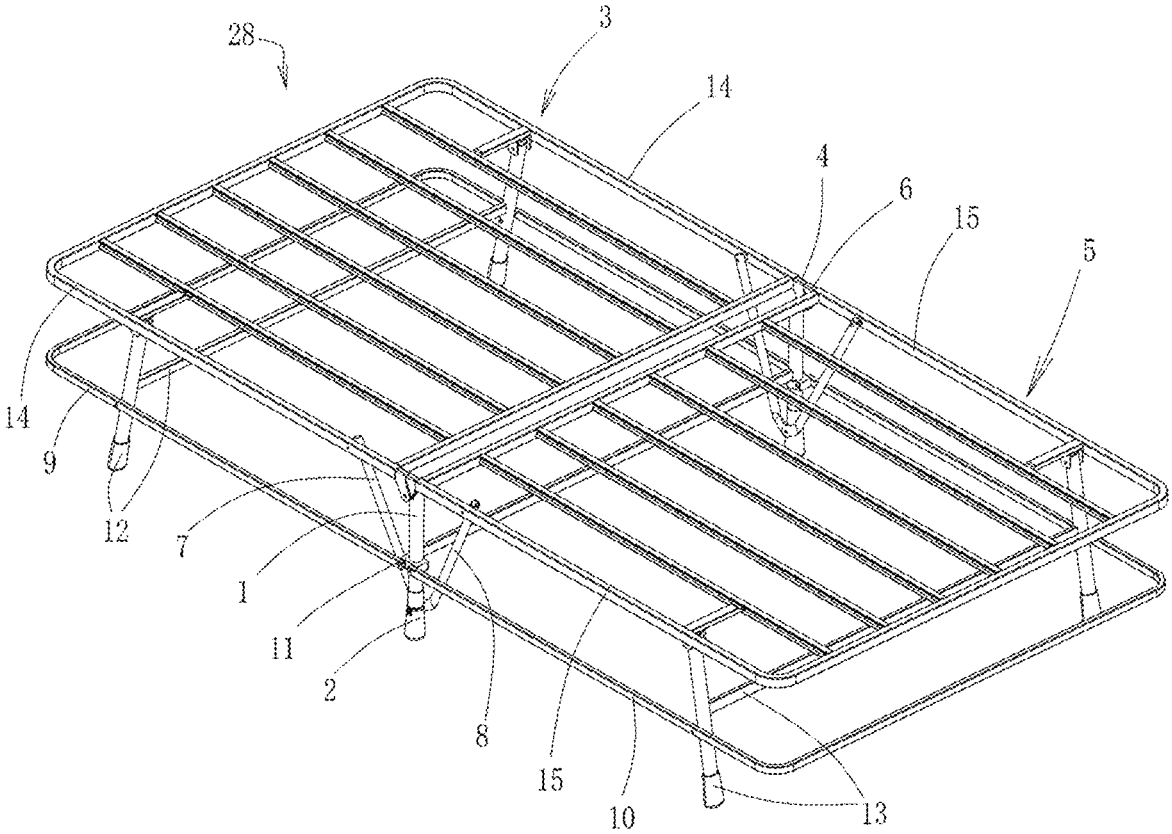
FIG. 1 exemplarily illustrates a perspective view of a bed frame according to a first embodiment of the present disclosure, in which a supporting device according to the first embodiment of the present disclosure is shown.
Figure 2:
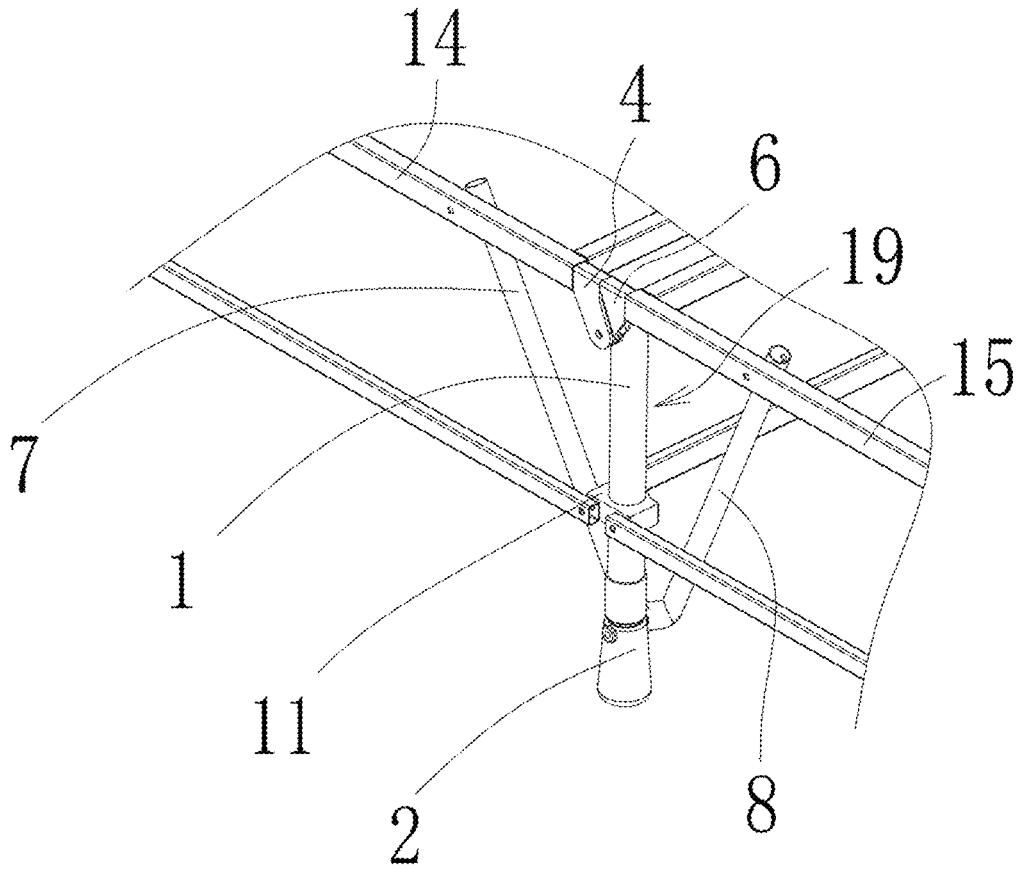
FIG. 2 is an enlarged view of a partial structure of the bed frame in FIG. 1.

Referring to FIGS. 1 and 2, the supporting device 19 adapted for a foldable bed frame according to the present disclosure is configured to be applied to a foldable bed frame. The supporting device comprises an upper support member 1 provided at an upper end thereof with a hinge structure configured to be connected with an upper bed frame folding part of the bed frame, and a movable support member 2 configured to be movably disposed on the upper support member 1 in a height direction of the bed frame and configured to contact the ground when in an extended position as so to cooperate with a ground support brace of the bed frame and support the bed frame, wherein the movable support member 2 is hinged thereon with a bracket that can be moved with the movable support member 2, and the bracket has a first diagonal pull rod 7 configured to hinge to a first side upper bed frame 3 of an upper bed frame, and a second diagonal pull rod 8 configured to hinge to a second side upper bed frame 5 of the upper bed frame.

In the above technical solution, the supporting device 19 for the foldable bed frame includes the upper support member 1 and the movable support member 2, the upper support member 1 is provided with a hinge structure including, for example, the first hinge portion 4 and the second hinge portion 6, the movable support member 2 can be movably disposed on the upper support member 1 in the height direction of the bed frame and is hinged thereon with the first diagonal pull rod 7 and the second diagonal pull rod 8, when the supporting device 19 is assembled with the first side upper bed frame 3 and the second side upper bed frame 5 to form a bed frame, the first side upper bed frame 3 and the second side upper bed frame 5 are connected with the hinge structure, for example, the first side upper bed frame 3 is connected with the first hinge portion 4, and the second side upper bed frame 5 is connected with the second hinge portion 6; and at the same time, the first diagonal pull rod 7 is hinged with the first side upper bed frame 3, and the second diagonal pull rod 8 is hinged with the second side upper bed frame 5. As such, when the unfolded bed frame is to be folded up, it is only required to lift up the middle portion of the bed frame, and then the first side upper bed frame 3 and the second side upper bed frame 5 can be rotated to be close to each other for folding. Meanwhile, the first diagonal pull rod 7 and the second diagonal pull rod 8 drive the movable support member 2 to move downwards, which in turn forces the first side upper bed frame 3 and the second side upper bed frame 5 to be further close to each other until the folding is completed. When the folded bed frame is to be unfolded, an one-action unfolding of the bed frame can be achieve only by respectively pull the first side upper bed frame 3 and the second side upper bed frame 5 in two opposite directions. After the bed frame is unfolded, since the first diagonal pull rod 7 is obliquely connected between the first side upper bed frame 3 and the movable support member 2 while the second diagonal pull rod 8 is obliquely connected between the second side upper bed frame 5 and the movable support member 2, the first diagonal pull rod 7 and the second diagonal pull rod 8 can respectively form a triangular support structure at two sides of the movable support member 2, which does not require additional self-locking structures to lock the unfolded state. This can further improve the stability of the unfolded bed frame. Therefore, the bed frame assembled with the folding supporting device is simple in structure, the bed frame can be folded or unfolded through one action, thereby reducing the folding steps and improving the convenience in use, and can enhance stability of the unfolded bed frame.

In addition, referring to FIGS. 1 and 2, the upper support member 1 includes a side enclosure rod hinge portion 11 configured to respectively hinge to a first lower side enclosure rod 9 and a second lower side enclosure rod 10 of the bed frame, wherein the first lower side enclosure rod 9 is configured to be hinged to a first ground support brace 12 hinged onto the first side upper bed frame 3, and the second lower side enclosure rod 10 is configured to be hinged to a second ground support brace 13 hinged onto the second side upper bed frame 5. As such, when the supporting device 19 is assembled to form a bed frame, the first lower side enclosure rod 9 and the second lower side enclosure rod 10 are hinged to the side enclosure rod hinge portion 11, and the first lower side enclosure rod 9 is hinged to the first ground support brace 12, and the second lower side enclosure rod 10 is hinged to the second ground support brace 13, such that in the folding process of the first side upper bed frame 3 and the second side upper bed frame 5, the first lower side enclosure rod 9 and the second lower side enclosure 10 respectively drive the first ground support brace 12 and the second ground support brace 13 to invert over respectively towards two ends of the bed frame (i.e., outwards) to complete folding of the first ground support brace 12 and the second ground support brace 13. In the unfolding process of the first side upper bed frame 3 and the second side upper bed frame 5, the first lower side enclosure rod 9 and the second lower side enclosure side 10 respectively drive the first ground support brace 12 and the second ground support brace 13 to invert over respectively inwards, such that the first ground support brace 12 and the second ground support brace 13 support the first side upper bed frame 3 and the second side upper bed frame 5, respectively.

It is worth nothing that the supporting device may be an independent product, not including the features of "a first lower side enclosure rod 9 and a second lower side enclosure rod 10, a first ground support brace 12 hinged onto the first side upper bed frame 3, and a second ground support brace 13 hinged onto the second side upper bed frame 5." Those features are introduced here only to illustrate the usage of the side enclosure rod hinge portion 11.

In the supporting device, the hinge structure may include one hinge portion. For example, the first side upper bed frame 3 and the second side upper bed frame 5 of the upper bed frame are hinged via one hinge point, and the hinge portion at the upper end of the upper support member 1 is connected with said one hinge point. In an alternative embodiment, the hinge structure includes a first hinge portion 4 for mounting the first side upper bed frame 3, and a second hinge portion 6 for mounting the second side upper bed frame 5. For example, the hinge structure includes two hinge portions hinged together. In the case, there is no need for hinging the first side upper bed frame 3 and the second side upper bed frame 5 of the upper bed frame via a hinge point, and the first side upper bed frame 3 and the second side upper bed frame 5 are only hinged to the first hinge portion 4 and the second hinge portion 6, respectively.

In the supporting device, the first hinge portion 4 and the second hinge portion 6 may be arranged in multiple forms. For example, in an arrangement of the first hinge portion 4 and the second hinge portion 6, referring to FIG. 2, the first hinge portion 4 and the second hinge portion 6 are hinged with the upper end of the upper support member 1 at the same hinge point, wherein the first hinge portion 4 includes a first engagement post or first engagement slot for fitting with a first edge side rod 14 of the first side upper bed frame 3, and the second hinge portion 6 includes a second engagement post or second engagement slot for fitting with a second edge side rod 15 of the second side upper bed frame 5. As such, in the actual use of the supporting device, as long as the first engagement post or the first engagement slot is in fitting with the first edge side rod 14 of the first side upper bed frame 3 and the second engagement post or the second engagement slot is in fitting with the second edge side rod 15 of the second side upper bed frame 5, the hinged connection between the first side upper bed frame 3 and the second side upper bed frame 5 can be achieved.

Figure 7:
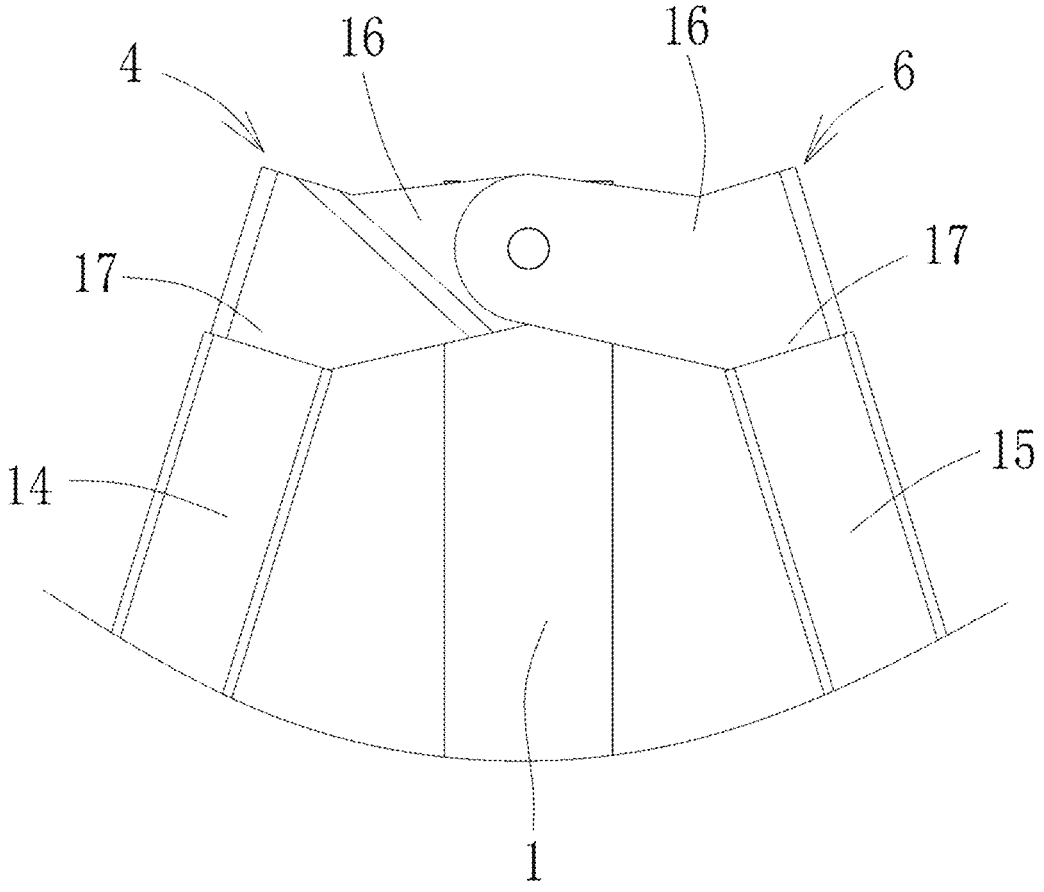
FIG. 7 is an enlarged view of a partial structure of the bed frame in FIG. 6.
Figure 8:
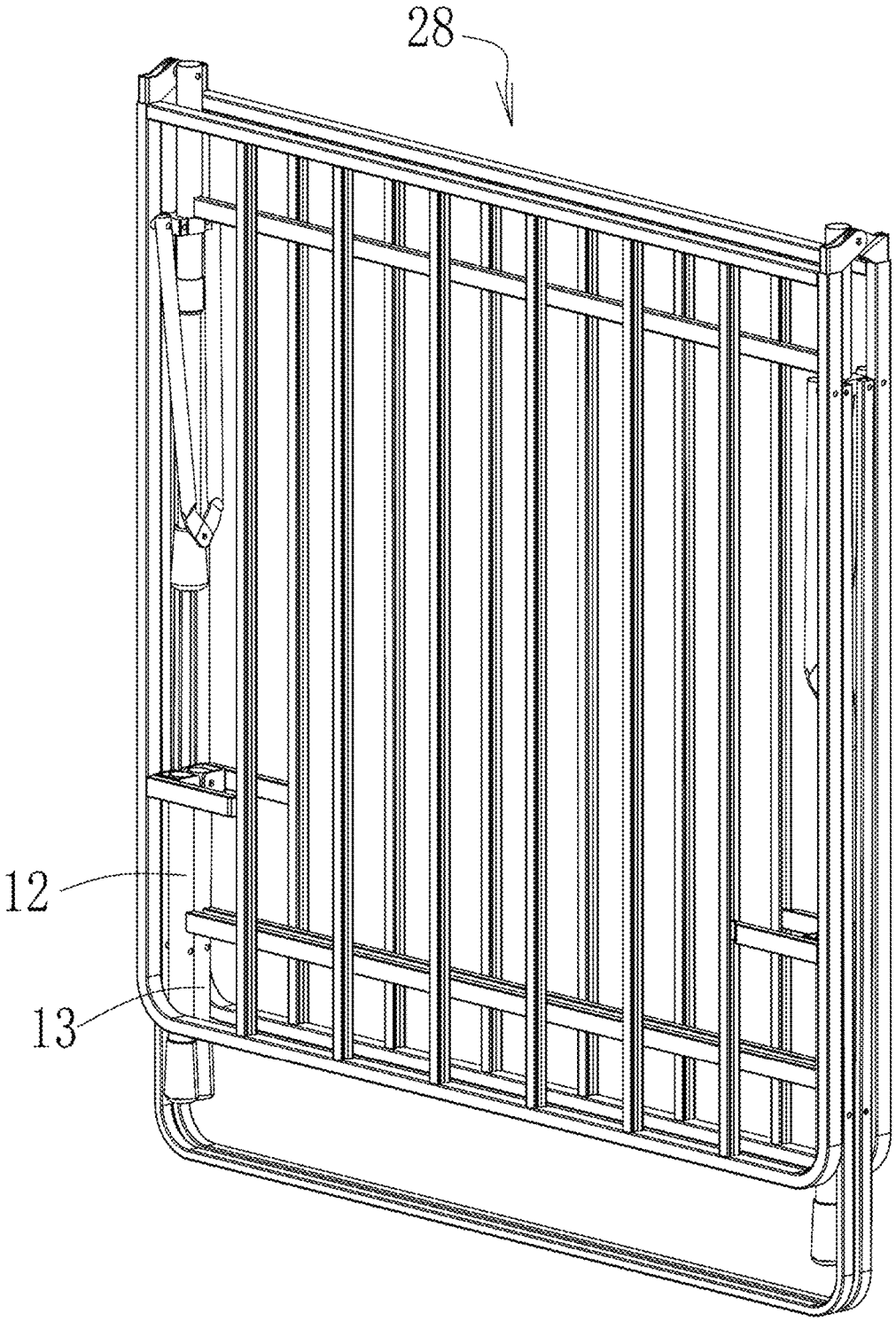
FIG. 8 is a perspective view of the bed frame in FIG. 5 having been folded.

The first hinge portion 4 and the second hinge portion 6 may have multiple structures. For example, in one structure, the first hinge portion 4 and the second hinge portion 6 may be block members each having an engagement post or engagement slot. Alternatively, referring to FIG. 7, in a further structure, each of the first hinge portion 4 and the second hinge portion 6 is shaped by bending a same plate sheet to form a hinge plate portion 16, an engagement plate portion 17 or an engagement plate slot. For example, one single plate sheet can be bent and cut to form the first hinge portion 4 or the second hinge portion 6. For instance, one single plate sheet is bent to form a U-shaped clip, where a portion of the inner space of the U-shaped clip may be used as the engagement plate slot, and the engagement end on the first side upper bed frame 3 or the second side upper bed frame 5 may be engaged with the engagement plate slot.

Figure 9:
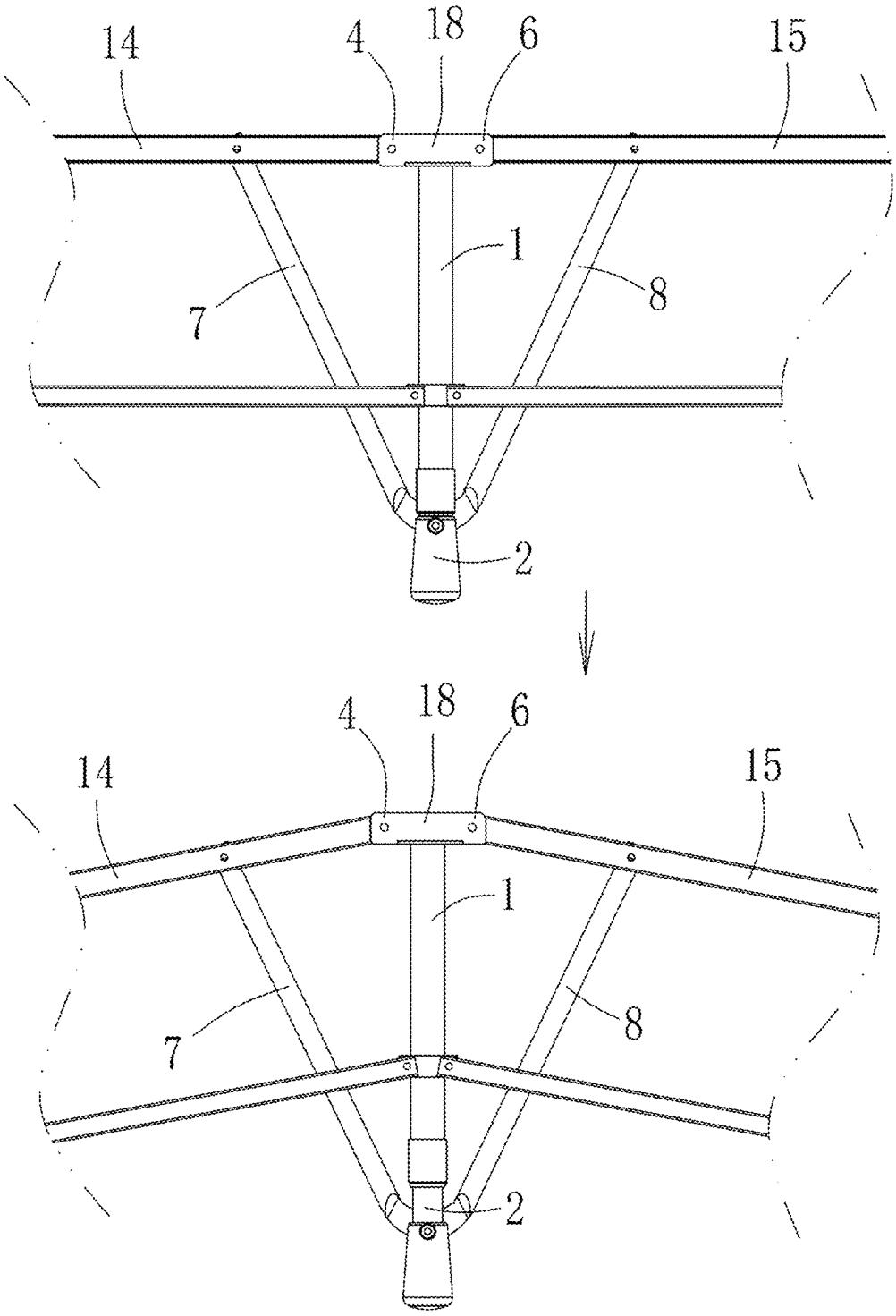
FIG. 9 exemplarily illustrates a schematic diagram of folding a bed frame according to a second embodiment of the present disclosure.
Figure 10:
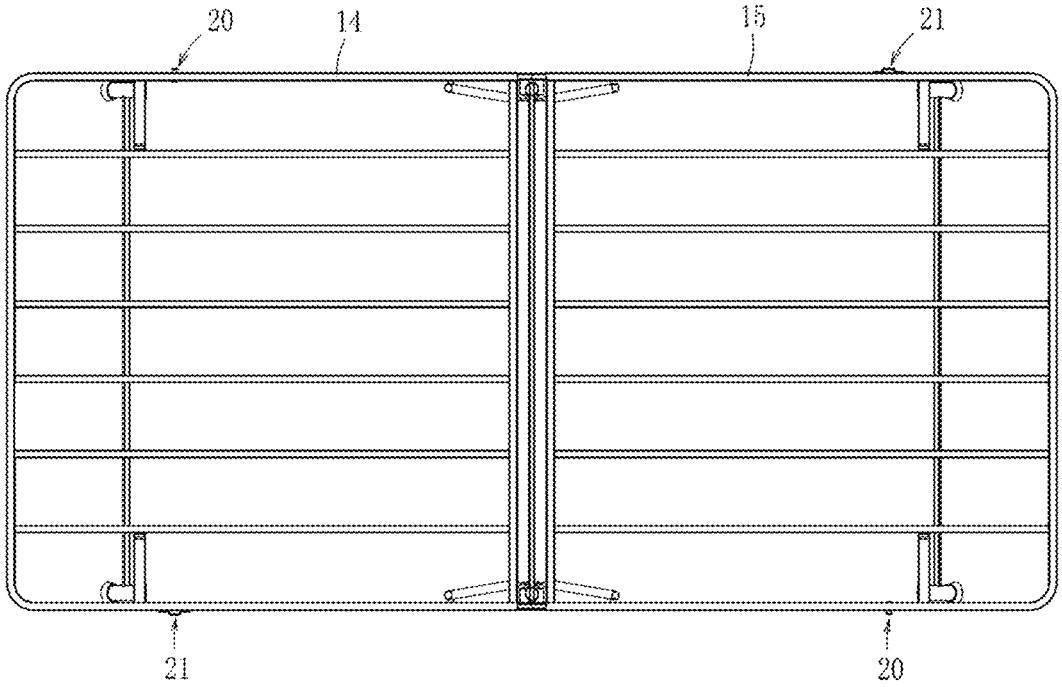
FIG. 10 exemplarily illustrates a schematic diagram of folding a bed frame according to a third embodiment of the present disclosure.

In a further arrangement of the first hinge portion 4 and the second hinge portion 6, referring to FIG. 9, the upper support member 1 is fixedly provided at its upper end with a mounting plate 18, and two opposite ends of the mounting plate 18 are respectively served as the first hinge portion 4 and the second hinge portion 6. For example, a hinge hole is respectively formed at the two opposite ends of the mounting plate 18. In this way, by means of cooperation of the hinge hole and the hinge pin shaft, the first side upper bed frame 3 or the second side upper bed frame 5 can be hinged. Alternatively, a hinge post is formed at the two opposite ends of the mounting plate 18, respectively, and the hinge post can mate with the hinge hole on the first side upper bed frame 3 or the second side upper bed frame 5 to achieve the hinge connection of the first side upper bed frame 3 or the second side upper bed frame 5.

Figure 6:
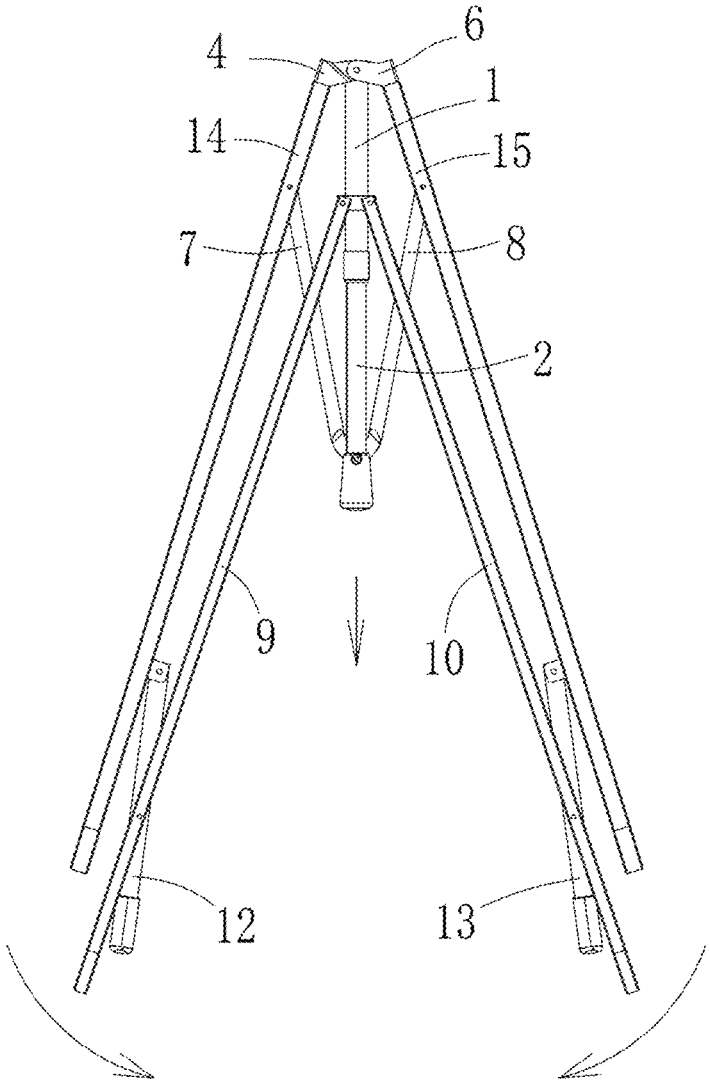
FIG. 6 is a side view of the structure of the bed frame in FIG. 5.

The feature of "the movable support 2 is movably disposed on the upper support member 1 in the height direction of the bed frame" can be implemented in multiple forms. For example, in one form, the upper support member 1 is formed thereon with a groove, the movable support member 2 is formed thereon with a bump, and the bump is slidably fit into the groove, to thus enable the movable support member 2 to move on the upper support member 1. Alternatively, in a further form, referring to FIGS. 6 and 9, the upper support member 1 is provided therein with an axial channel. For example, the upper support member 1 may be a hollow cylinder which may be an annular or square cylinder, and the movable support member 2 can be telescopically disposed within the axial channel. In the case, due to the axial channel, the weight of the supporting device can be reduced. In addition, as limited by the peripheral wall of the axial channel, the movement of the movable support member 2 can be guided more stably.

In the supporting device, the length of the first diagonal pull rod 7 and the second diagonal pull rod 8 can be adjusted respectively. For example, the first diagonal pull rod 7 and the second diagonal pull rod 8 respectively include a plurality of cylinder sections nested in sequence that can extend and telescope, and be locked if extended or retracted to a desired length. Alternatively, the supporting device includes a plurality of replaceable diagonal pull rods varied in length, such that a diagonal pull rod having a desired length can be used if required. Since the lengths of the first diagonal pull rod 7 and the second diagonal pull rod 8 can be adjusted, the first diagonal pull rod 7 and the second diagonal pull rod 8 are respectively hinged to different positions of the first side upper bed frame 3 and the second side upper bed frame 5 in the length direction thereof according to the needs, for example, which may be hinged to the middle positions of the first side upper bed frame 3 and the second side upper bed frame 5, or other positions adjacent to the middle parts. In this way, the first side upper bed frame 3 and the second side upper bed frame 5 can be obliquely supported at middle positions of the first side upper bed frame 3 and the second side upper bed frame 5, or at other positions adjacent to the middle parts, to thus further improve the stability of the first side upper bed frame 3 and the second side upper bed frame 5.

The present disclosure provides a bed frame. Referring to FIGS. 1-9, the bed frame 28 includes an upper bed frame comprising a first side upper bed frame 3 and a second side upper bed frame 5, and two separated supporting devices 19 according to any one of the embodiments as described above, wherein an end of the first side upper bed frame 3 and an end of the second side upper bed frame 5 are mounted to the hinge structures of the two supporting devices 19. For example, one end of the first side upper bed frame 3 is mounted to the first hinge portions 4 of the two supporting devices 19, one end of the second side upper bed frame 5 is mounted to the second hinge portions 6 of the two supporting devices 19, the first diagonal pull rod 7 is hinged to the first side upper bed frame 3, and the second diagonal pull rod 8 is hinged to the second side upper bed frame 5. The first side upper bed frame 3 and the second side upper bed frame 5 can be unfolded and folded.

In the technical solution, as described above, with the supporting devices 19 according to the above disclosure, the bed frame has a simple structure, can be folded and unfolded through one action, thereby reducing the folding steps and improving the convenience in use, and can enhance the stability when unfolded.

Figure 3:
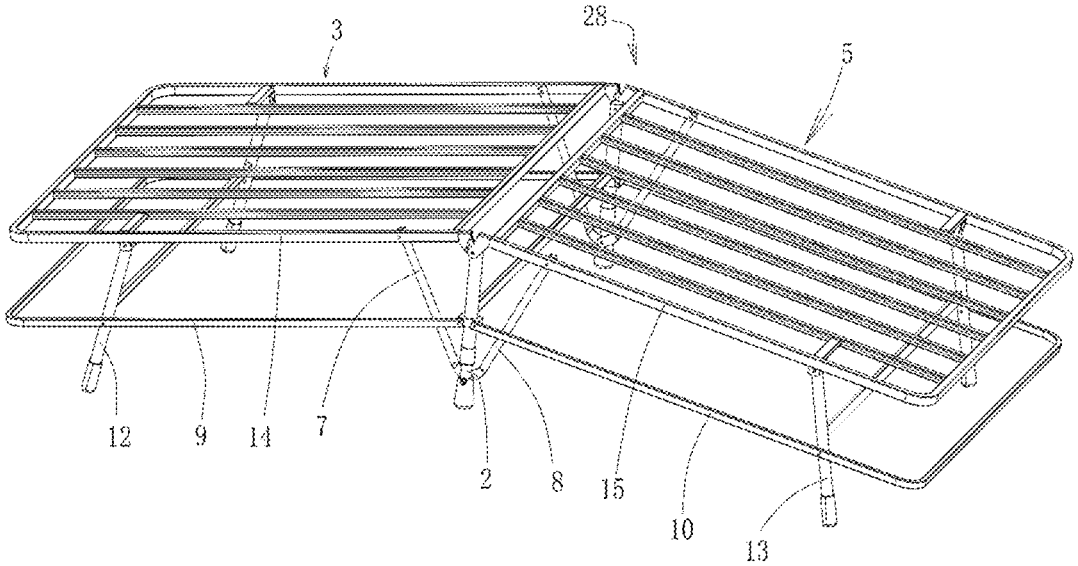
FIG. 3 is a schematic diagram of a folding process of the bed frame in FIG. 1.
Figure 4:
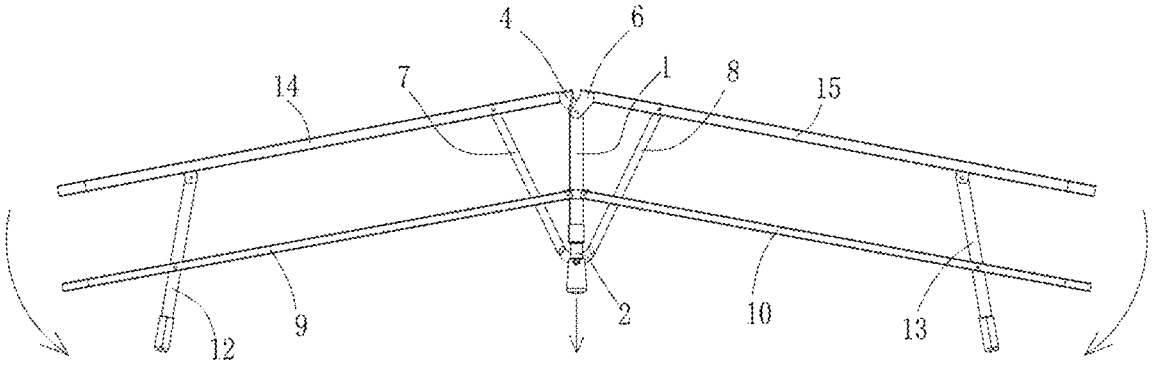
FIG. 4 is a side view of a structure of the bed frame in FIG. 3.
Figure 5:
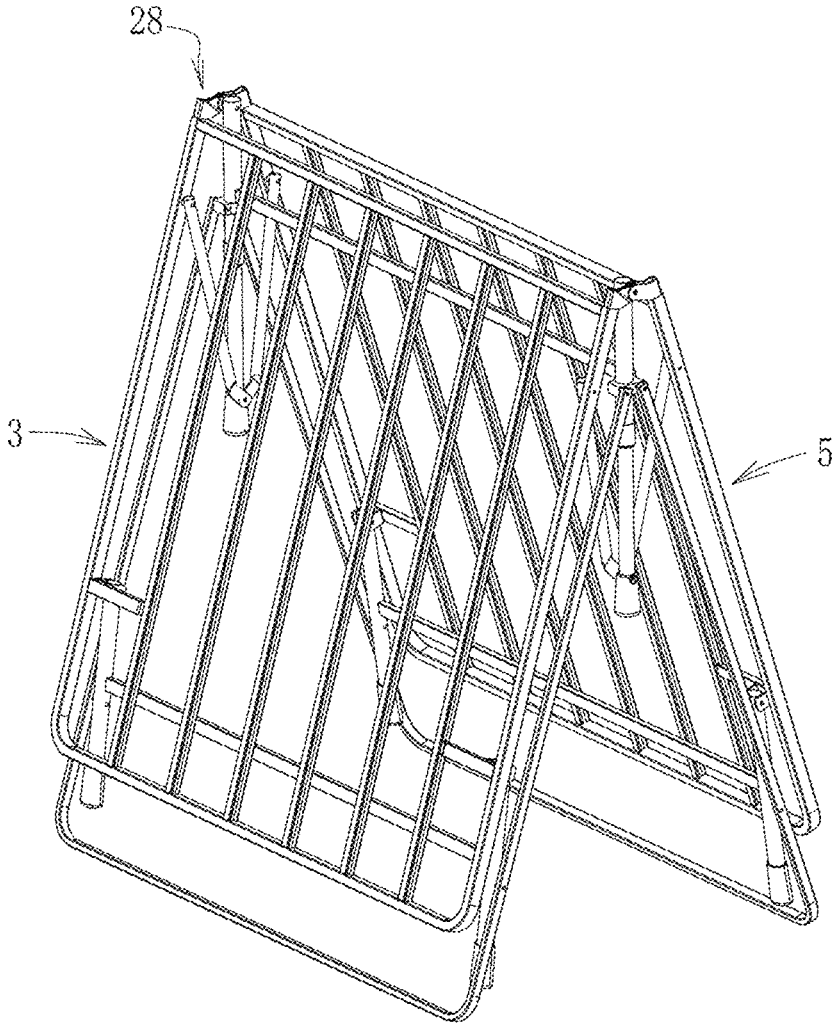
FIG. 5 is a perspective view of the further folded bed frame in FIG. 3.

Referring to FIGS. 1, 3 and 4, the bed frame 28 includes a first lower side enclosure rod 9 and a second lower side enclosure rod 10, where the two ends of the first lower side enclosure rod 9 are hinged to the upper support members 1, and the rod section between the two ends of the first lower side enclosure rod 9 is hinged to the first ground support brace 12 hinged onto the first side upper bed frame 3 such that the first side upper bed frame 3, the first ground support brace 12, the first lower side enclosure rod 9 and the upper support member 1 can form a four-rod linkage. Wherein, when the first side upper bed frame 3 and the second side upper bed frame 5 are folded, the first lower side enclosure rod 9 can drive the first ground support brace 12 to invert over and fold towards the end of the bed frame (i.e., outwards), and the second lower side enclosure rod 10 can drive the second ground support brace 13 to invert over and fold towards an opposite end of the bed frame (i.e., outwards). In the unfolding process of the first side upper bed frame 3 and the second side upper bed frame 5, the first lower side enclosure rod 9 and the second lower side enclosure rod 10 can respectively drive the first ground support brace 12 and the second ground support brace 13 to invert over inwards, such that the first ground support brace 12 and the second ground support brace 13 can support the first side upper bed frame 3 and the second side upper bed frame 5, respectively.

The first lower side enclosure rod 9 connects the first ground support brace 12 with the upper support member 1, and the second lower side enclosure rod 10 connects the second ground support brace 13 with the upper support member 1. This can improve the stability of the unfolded bed frame. Moreover, the first lower side enclosure rod 9 and the second lower side enclosure rod 10 bring convenience for connecting a side enclosure cover (not shown), i.e., the side enclosure cover may be connected to the first lower side enclosure rod 9, the second lower side enclosure rod 10, the first side upper bed frame 3 and the second side upper bed frame 5 to cover the bed frame, thus making the appearance of the bed more pleasing.

Figure 14:
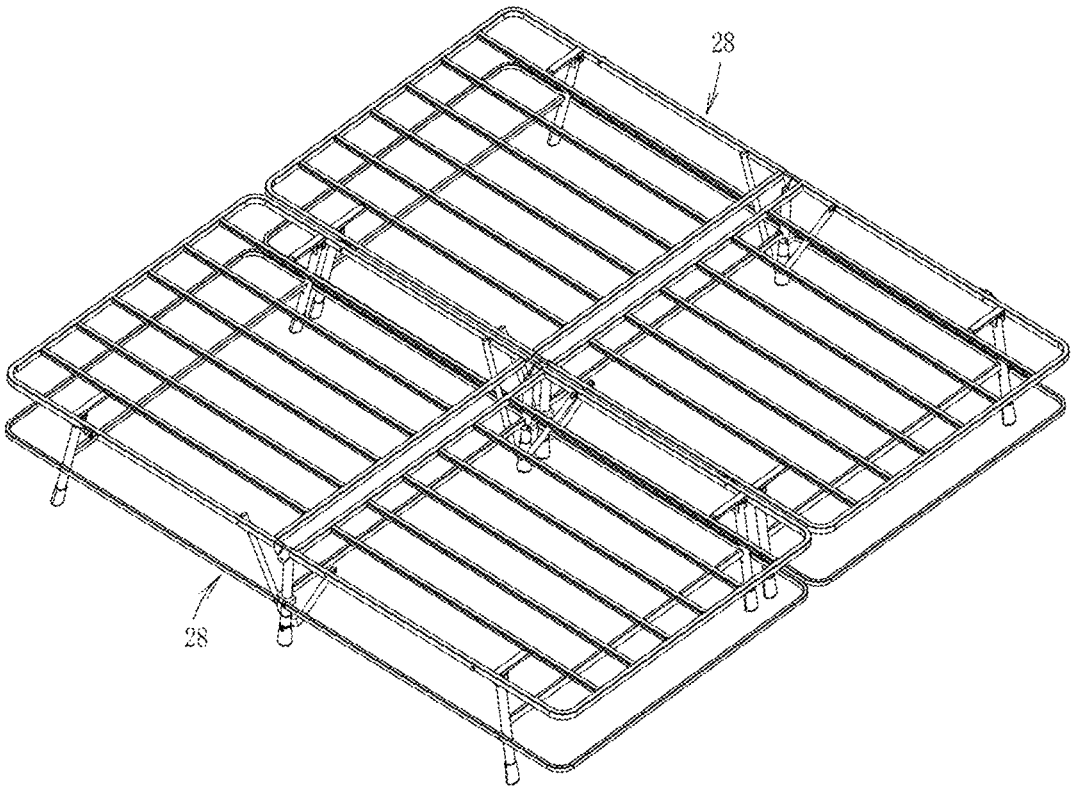
FIG. 14 is a perspective view of two bed frames in FIG. 10 that are spliced.

In an alternative embodiment of the bed frame, referring to FIGS. 10-12 and 14, the first side upper bed frame 3 and the second side upper bed frame 5 are provided at side edges thereof with a plurality of connection structures for allowing a plurality of bed frames to be spliced and connected in sequence. The side edges of the first side upper bed frame 3 and the second side upper bed frame 5 may be a first edge side rod 14 and a second edge side rod 15, respectively. As shown in FIG. 14, a plurality of (e.g. two) bed frames may be spliced and connected to form a larger bed frame, to flexibly meet specific needs of users. Of course, three of the bed frames can also be spliced and connected in a row.

In an embodiment of the bed frame, the bed structure has an extended position where the connection structure protrudes from the side edge, and a retracted position where the connection structure is positioned lower than the side edge. For example, the connection structure can be extended and retracted or flipped between the extended position and the retracted position. When splicing is required, the connection structure is in the extended position to connect with a further bed frame of this type. When a single bed frame is required in use, the connection structure is in the retracted position, to prevent the connection structure from damaging users or bedding materials.

Figure 11:
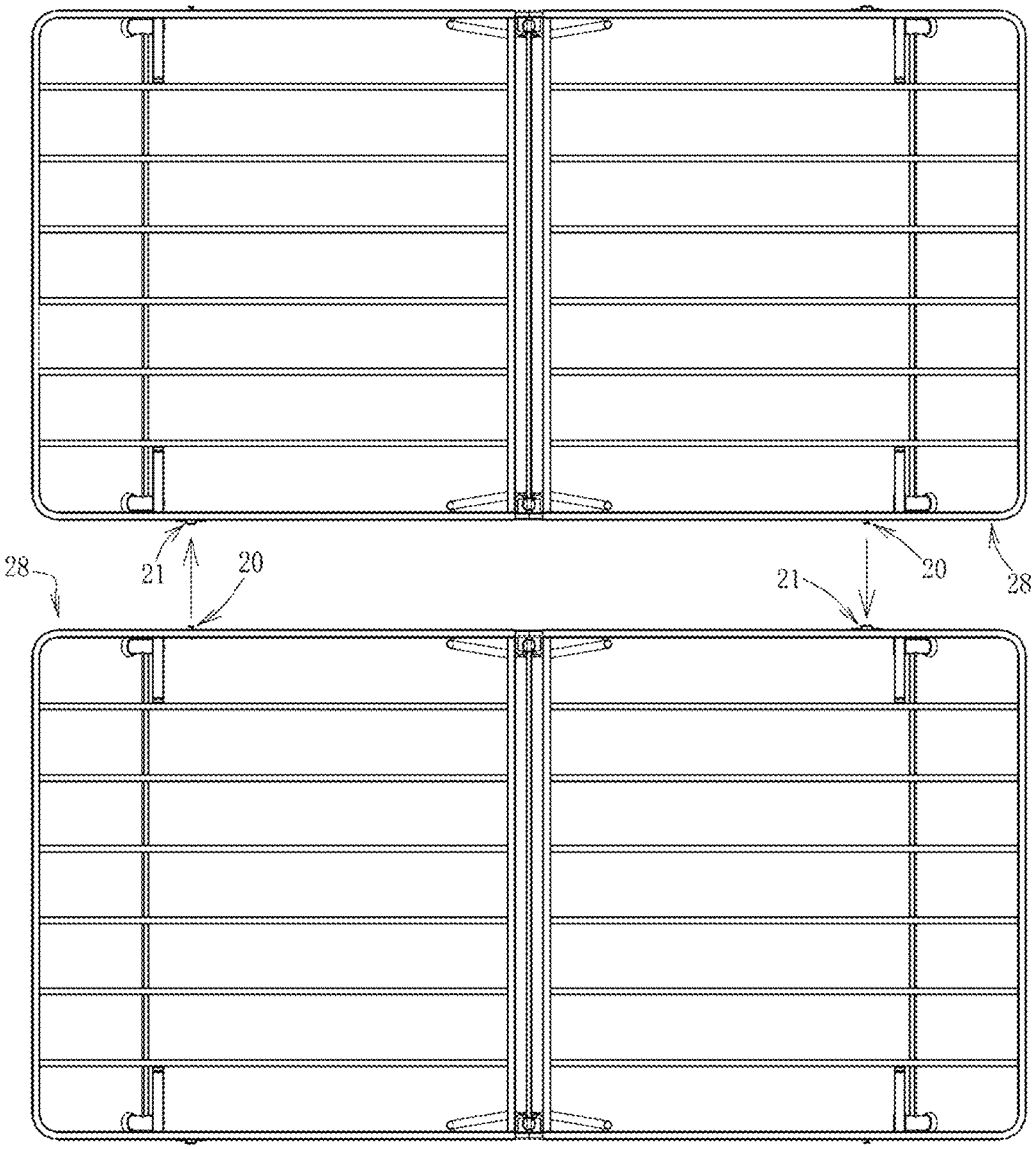
FIG. 11 is a top view of structures of two bed frames in FIG. 10 that are spliced.
Figure 12:
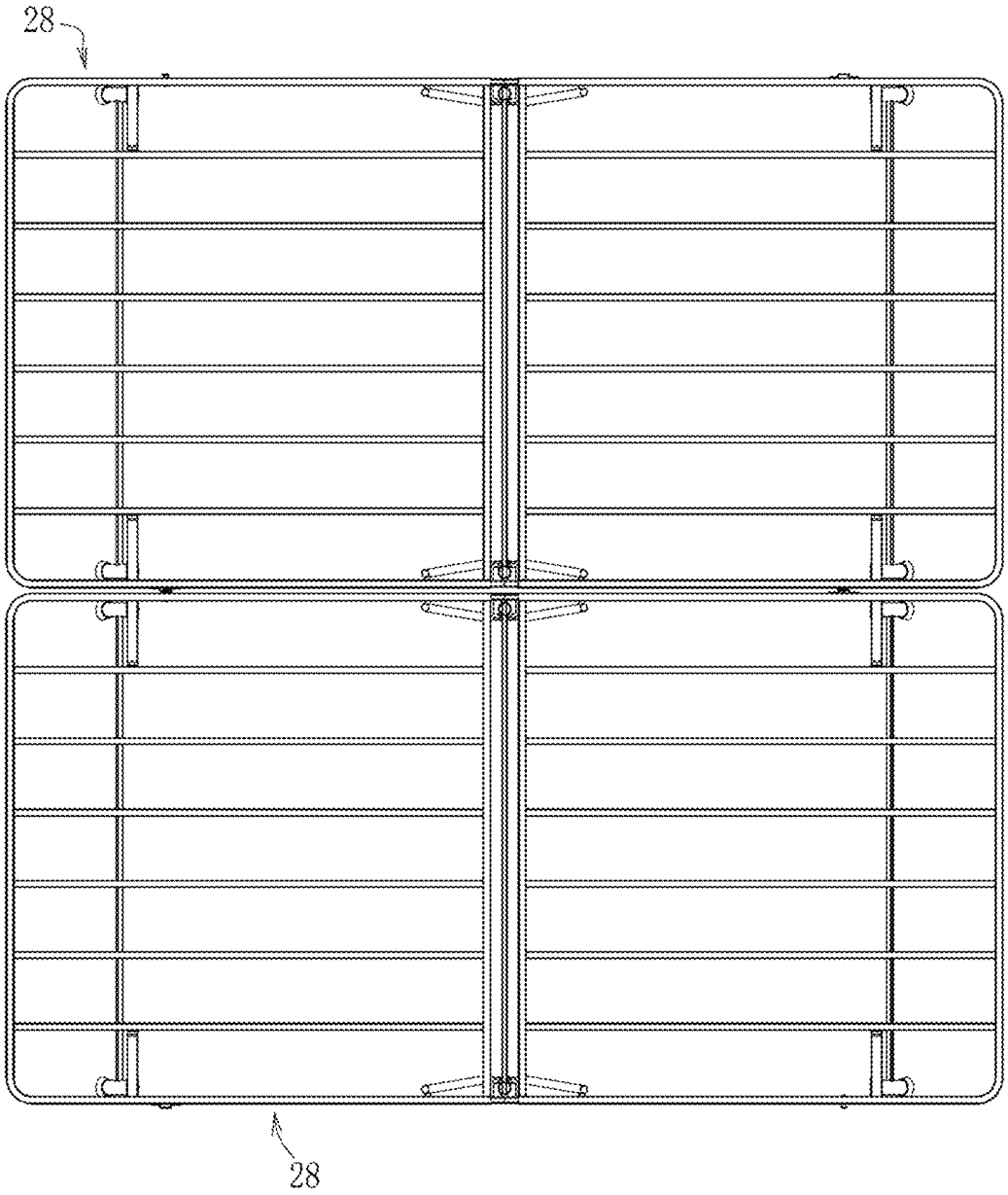
FIG. 12 is a top view of the spliced structure of the two bed frames in FIG. 10, as shown in FIG. 11.

Referring to FIG. 11, the connection structure includes a first structure 20 and a second structure 21 that are different and can cooperate with each other, where the first structure 20 and the second structure 21 are respectively located on side edges at two opposite sides of the first side upper bed frame 3 and the second side upper bed frame 5, i.e., the first structure 20 and the second structure 21 are respectively disposed on side edges of two opposite sides of the first side upper bed frame 3, and the first structure 20 and the second structure 21 are likewise respectively disposed on side edges of two opposite sides of the second side upper bed frame 5. However, the first structure on one side of the first side upper bed frame 3 and the second structure on one side of the second side upper bed frame 5 are located on the same side surface, and the second structure on the other side of the first side upper bed frame 3 and the first structure on the other side of the second upper side upper bed frame 5 are located on the same side surface. As indicated by the arrows in FIG. 11, during connection, the first structure 20 of the first side upper bed frame 3 of a bed frame is connected to the second structure 20 of the first side upper bed frame 3 of a further bed frame, and the second structure 21 of the second side upper bed frame 5 of the bed frame is connected to the first structure 2 of the second side upper bed frame 5 of the further bed frame. In this way, with the staggered arrangement of the first structure 20 and the second structure 21, the stability of a plurality of bed frames after splicing and connection can be effectively improved.

Figure 13:
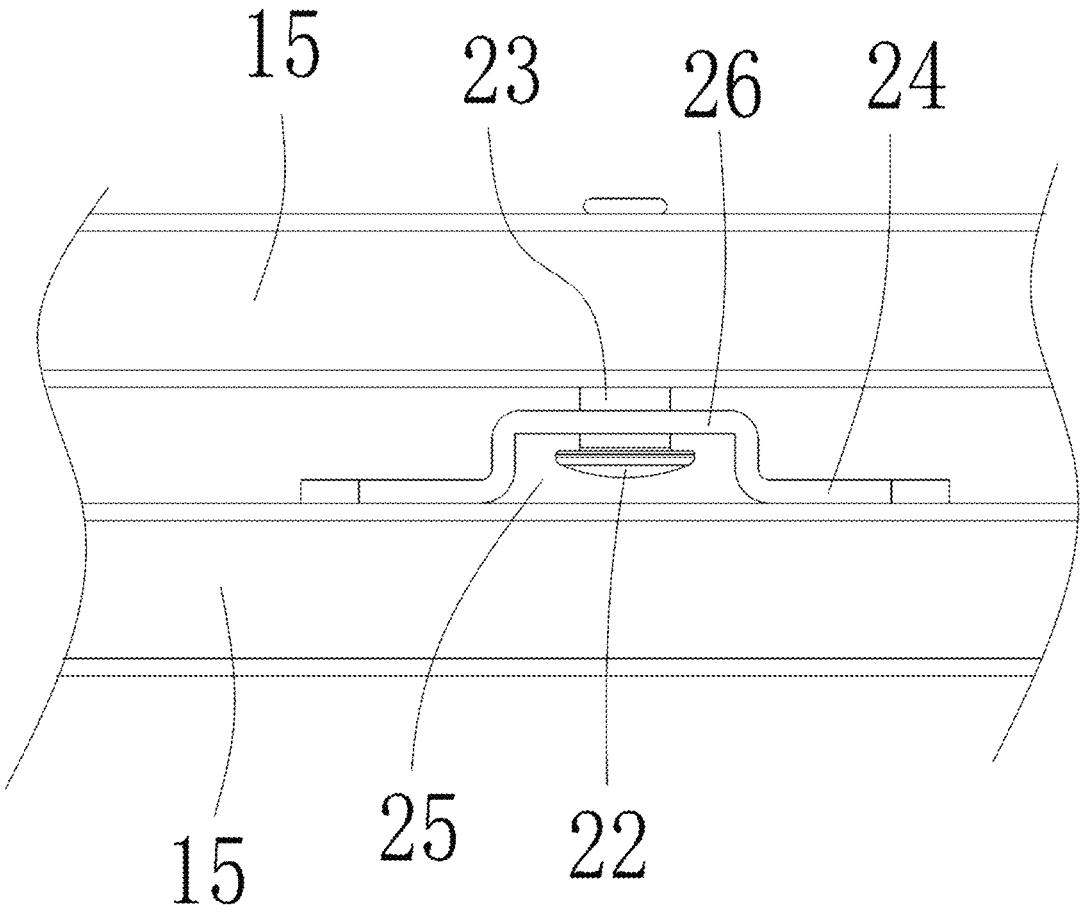
FIG. 13 is an enlarged view of the partial structure in FIG. 12.
Figure 15:
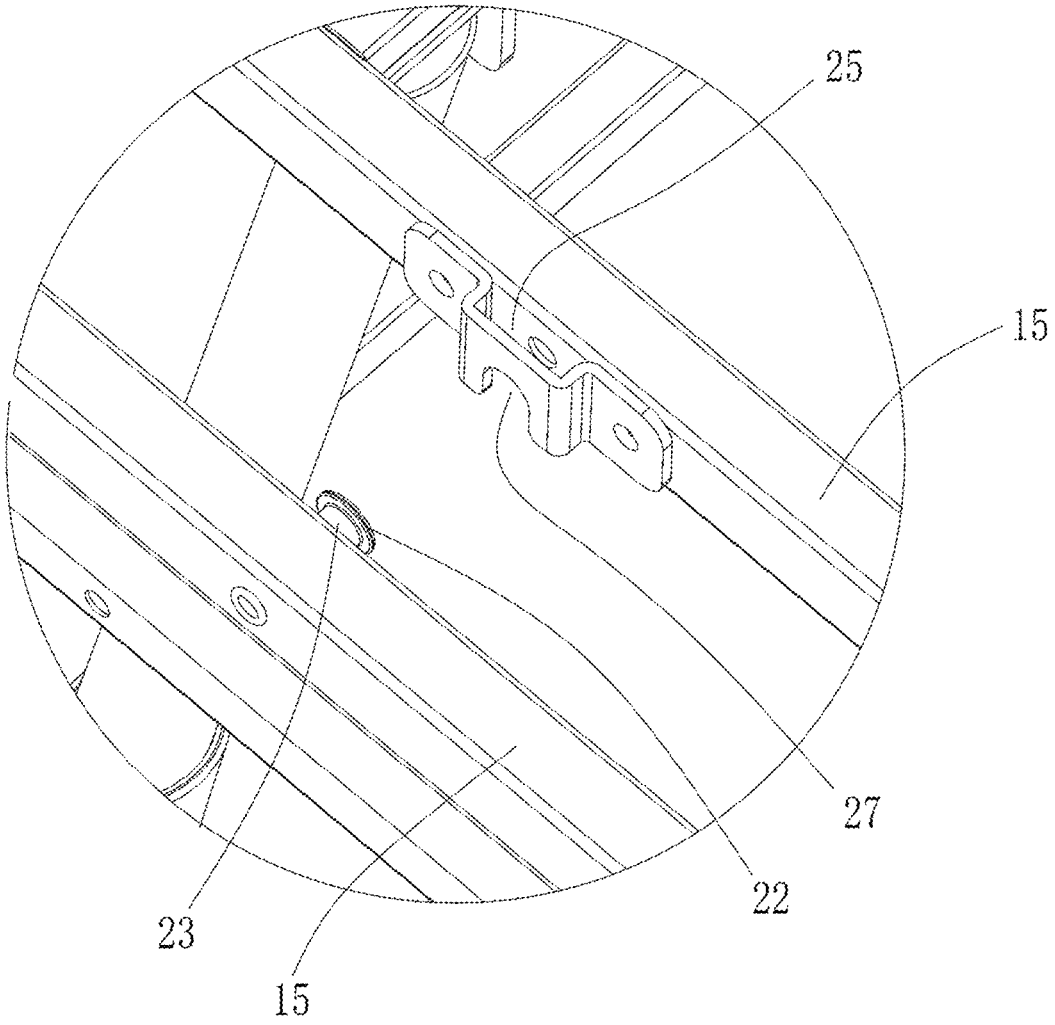
FIG. 15 is an enlarged view of the partial structure in FIG. 14.

In the bed frame 28, the first structure and the second structure may be of multiple forms. For example, in one form, one of the first structure and the second structure may be a connection hole while the other one may be a connection post that can be fitting into the connection hole. Alternatively, referring to FIGS. 13 and 15, the first structure includes a hitching post 23 having a stop head 22, the second structure includes a hitching sheet 24 that includes a raised sheet portion 26 forming a receiving space 25 and having an entrance port 27, where the hitching post 23 can enter the entrance port 27 such that the stop head 22 is located within the receiving space 25 and stopped on the inner surface of the raised sheet portion 26. As shown in FIG. 13, since the stop head 22 is located within the receiving space 25 and stopped on the inner surface of the raised sheet portion 26, the bed frames can be connected stably and reliably.

In addition, the present disclosure provides a bed comprising a bed frame 28 according to any one of the above-described disclosure and embodiments. Therefore, as described above, the bed can be improved effectively with respect to quality.

The scope of protection of the present disclosure is defined only by the appended claims. Given the teaching of the present disclosure, those skilled in the art could easily envision using alternative structures of those disclosed herein as feasible alternative embodiments, and combining the embodiments disclosed herein to form new embodiments, which should all fall into the scope defined by the appended claims.

I claim:

1. A supporting device for a foldable bed frame, comprising:

an upper support member;

a hinge at an upper end of the upper support member;

a movable support member vertically movable on the upper support member;

a bracket on the movable support member; and first and second diagonal pull rods, a first end of each pull rod pivotally attached to the bracket;

a rod hinge on the upper support member;

a first lower rod pivotally attached to the rod hinge and to a first ground support brace; and a second lower rod pivotally attached to the rod hinge and to a second ground support brace.

2. The supporting device of claim 1 wherein the hinge is configured to pivotally attach first and second upper bed frames to the upper support member.

3. The supporting device of claim 2 wherein a second end of the first diagonal pull rod and of the second diagonal pull rod is pivotally attached to the first upper bed frame and to the second upper bed frame, respectively.

4. The supporting device of claim 3 wherein a bottom end of the movable support member is configured to extend and contact a ground surface as the supporting device is moved into a folded position.

5. The supporting device of claim 1 wherein an edge side rod of each of the first and second upper bed frames is attached to the hinge by an engagement post or slot.

6. The supporting device of claim 1 wherein the hinge includes a first portion and a second portion shaped by bending a plate to form a hinge plate portion, an engagement plate post or an engagement plate slot.

7. The supporting device of claim 1 wherein the hinge comprises a mounting plate having opposite ends providing first and second hinge portions.

8. The supporting device of claim 1 wherein the movable support member is telescopically attached to the upper support member.

9. The supporting device of claim 1 wherein each diagonal pull rod has an adjustable length.

10. The supporting device of claim 1 wherein: the first upper bed frame, the first ground support brace, the first lower rod and the upper support member form a first four-rod linkage; and the second upper bed frame, the second ground support brace, the second lower rod and the upper support member form a second four-rod linkage; wherein, the first and second upper bed frames when unfolded together form a bed frame unit, and wherein when upper bed frames are folded, the first lower rod drives the first ground support brace to invert over and fold towards a first end of the bed frame unit, and the second lower rod drives the second ground support brace to invert over and fold towards a second end of the bed frame unit.

11. A folding bed frame, comprising:

an upper support member;

a hinge at an upper end of the upper support member;

first and second upper bed frames pivotally attached to the upper support member via the hinge;

a movable support member vertically movable on the upper support member;

a bracket on the movable support member;

first and second diagonal pull rods, a first end of each pull rod pivotally attached to the bracket;

a rod hinge on the upper support member;

a first lower rod pivotally attached to the rod hinge and to a first ground support brace; and a second lower rod pivotally attached to the rod hinge and to a second ground support brace.

12. The folding bed frame of claim 11 further including connectors on side edges of the first and second upper bed frames, the connectors configured to attach a plurality of the folding bed frames together.

13. The bed frame of claim 12 wherein one or more of the connectors has an extended position where the connector protrudes from a side edge of the first and/or second upper bed frame, and a retracted position where the connector does not protrude from the side edge.

14. The bed frame of claim 12 wherein the connector comprises a first structure and a second structure that are different and are configured to cooperate with each other, wherein the first structure and the second structure are respectively located on side edges of two opposite sides of the first upper bed frame and the second upper bed frame.

15. The bed frame of claim 14 wherein the first structure comprises a hitching post having a stop head, and the second structure comprises a hitching sheet that comprises a raised sheet portion forming a receiving space and having an entrance port, wherein the hitching post is configured to enter the entrance port such that the stop head is located in the receiving space and stopped on an inner surface of the raised sheet portion.

* * * * *